US005298320A

United States Patent [19]

Geoffrey

[11] Patent Number: 5,298,320

[45] Date of Patent: Mar. 29, 1994

[54] NON-WOVEN MATERIAL CONTAINING WOOL

[75] Inventor: Robert R. S. Geoffrey, Ocean Grove, Australia

[73] Assignee: Commonwealth Sceintific and Industrial Research Organisation, Australian Commonwealth Territory, Australia

[21] Appl. No.: 905,203

[22] Filed: Jun. 26, 1992

Related U.S. Application Data

[63] Continuation of Ser. No. 444,160, filed as PCT/AU88/00100, Apr. 8, 1988, published as WO88/08049, Oct. 20, 1988, abandoned.

[30] Foreign Application Priority Data

Apr. 10, 1987 [AU] Australia ..... PI1370/87

[51] Int. Cl.[5] ..... D04H 1/62

[52] U.S. Cl. ..... 428/288; 428/373; 428/296; 428/198; 428/270; 8/128.1; 264/122; 264/123; 156/62.2; 156/180; 156/296; 156/308.6

[58] Field of Search ..... 156/62.2, 176, 178, 156/180, 296, 308.6; 8/127.6, 128.1; 264/122, 123; 428/198, 280, 270, 296, 288, 373

[56] References Cited

U.S. PATENT DOCUMENTS

| | | | |
|---|---|---|---|
| 2,277,049 | 3/1942 | Reed | 428/280 |
| 2,500,282 | 3/1950 | Francis | 428/296 |
| 2,548,774 | 4/1951 | Coe | 8/128.1 |
| 2,671,006 | 3/1954 | McLauchlan | 8/128.1 |
| 2,900,291 | 8/1959 | O'Connell | 264/126 |
| 3,010,858 | 11/1961 | Sexsmith | 264/123 X |
| 3,062,610 | 11/1962 | Russon | 8/128.1 |
| 3,076,690 | 2/1963 | Hayashi | 8/128.1 |
| 3,097,913 | 7/1963 | Von Bergen | 8/128.1 |
| 3,619,322 | 11/1971 | Fleissner | 156/296 |
| 3,620,892 | 11/1971 | Wincklhofer et al. | 264/122 |
| 3,628,909 | 12/1971 | Goldberg | 8/128.1 X |
| 3,768,118 | 10/1973 | Ruffo et al. | 264/518 |
| 3,837,995 | 9/1974 | Floden | 428/296 |
| 3,883,300 | 5/1975 | Moore et al. | 8/127.6 |
| 4,083,913 | 4/1978 | Marshall | 264/122 |
| 4,319,879 | 5/1982 | Hojo et al. | 8/127.6 |
| 4,377,388 | 3/1983 | Mains | 8/128.1 |
| 4,457,793 | 7/1984 | Buck, Jr. | 156/296 X |
| 4,483,897 | 11/1984 | Fujimara | 428/288 |
| 4,657,555 | 4/1987 | Fleissner | 8/128.1 |

FOREIGN PATENT DOCUMENTS

| | | |
|---|---|---|
| 0014046 | 10/1971 | Australia . |
| 0032605 | 2/1973 | Australia . |
| 0079780 | 10/1976 | Australia . |
| 0032505 | 7/1979 | Australia . |
| 0034815 | 10/1979 | Australia . |
| 1307500 | 2/1973 | United Kingdom . |

OTHER PUBLICATIONS

WRONZ Report No. R128, Jan. 1986, "Thermo-bonding of Lofty Wool Batts with Low-melting-temperature Fibres".

Feldtman et al, "The Spreading and Adhesion of Polymers on Wool", Textile Research Journal, 34, pp. 634–642, 1964.

Goheen and DuPré, Jr., "The Chemical Treatment of Cotton and Wool", Chem Eng Prog Mar., 1956, vol. 52, No. 3, pp. 111–114.

*Primary Examiner*—Michael W. Ball

*Assistant Examiner*—Francis J. Lorin

*Attorney, Agent, or Firm*—Sughrue, Mion, Zinn, Macpeak & Seas

[57] ABSTRACT

A method of forming a non-woven material includes blending both synthetic and wool fibres in a web and stabilizing the web by utilizing a bonding medium to form dispersed bonds between the fibres. The wool fibres are subjected before formation of the web to a pretreatment effective to modify the epicuticle of the wool so as to substantially increase the surface energy of the wool fibres without destroying their integrity to an extent sufficient for the wool fibres to accept the bonding medium in the web. The dispersed bonds thereby include bonds with wool fibres substantially effective to hold the wool fibres of the material in the web.

13 Claims, No Drawings

NON-WOVEN MATERIAL CONTAINING WOOL

This is a continuation of application Ser. No. 07/444,160, filed Dec. 7, 1989, now abandoned.

BACKGROUND OF THE INVENTION

This invention relates to non-woven material containing wool, especially insulating material for clothing and bedding products, and in a particular aspect provides an insulating material formed predominantly from wool fibres.

Down is presently recognized as the superior lightweight filling for clothing and bedding products due to its excellent loftiness. High quality down has a volume fraction of 0.003, that is it contains only 0.3% fibre and 99.7% air by volume. This large volume of trapped, still air is vital to the excellent insulating properties of down and its high warmth to weight ratio. A second important characteristic of down is its high resilience, that is its ability to maintain excellent loft after repeated compressions and indeed through years of use.

A currently used synthetic substitute for down is a lightweight non-woven open web of polyester fibres. The web may be a conventional card web in which the fibres are partially aligned parallel to the web direction, or a random web in which there is no preferred orientation of the fibres. The resilience of the random web is considered to be superior to that of the partially aligned web. The open web structure is normally stabilized by some form of bonding. This bonding can be achieved by a variety of methods including chemical bonding methods and thermal bonding. A common form of chemical bonding is the use of either a spray adhesive (spray bonding) or bath immersion of the product in a solution of adhesive. Thermal bonding is a technique that appears to have a promising future and the non-woven industry has shown a trend towards this method. In thermal bonding, effective dispersed bonds are achieved by initially forming the web to include a portion of thermoplastic fibres of lower melting point than the majority of the polyester fibres. On heating the blend, the low melting point fibres melt to form droplets which on cooling bond and stabilise the structure. In a variation, the bonding is achieved using conjugate thermoplastic fibres, for example bicomponent fibres each in two parts, core and sheath, made from two different polymers of differing melting points. On heating, only one component melts and so the binder fibre maintains its integrity as a fibre rather than forming a droplet.

It is known that the properties of synthetic fibres may be enhanced in certain respects, by blending in a selected proportion of a staple natural fibre, such as wool. In particular, wool provides good moisture absorption capacity and therefore enhanced comfort for the user. A blended synthetic and wool insulating batt has been proposed in a paper by Hoffmeyer and Watt in WRONZ Report R128, January 1986, published by the Wool Research Organization of New Zealand (WRONZ). Various different lofty batts were formed as non-woven webs stablised by thermal bonding using a blend with mono or bicomponent bondable fibres and wool. Hoffmeyer and Watt reported that none of the fibres assessed gave a measurable bond to wool fibres, even when the latter had been pretreated by either scouring, solvent extraction, chlorination with 2.8% BASOLAN DC or chlorine-HERCOSETT treated with 2.8% BASOLAN DC followed by 2.8% HERCOSETT 57. Some of the webs at least mechanically trapped the wool fibres. The products were, however, observed to be poorly stabilised insofar as the wool fibres were concerned and to exhibit poor resilience and generally inferior properties relative to down.

A non-woven fabric comprised of thermoplastic fibres and wool fibres is disclosed in Australian patent 459539, wherein the wool fibres are said not to be interbonded to each other at their crossing points and only lightly bonded if at all at the points at which they cross the thermoplastic fibres, being held in the structure by mechanical constraint.

SUMMARY OF THE INVENTION

It is an object of the present invention to provide a non-woven material formed from synthetic and wool fibres, which is capable of substantially improving on the polyester/wool product of the Hoffmeyer and watt paper and the product of patent 459539, and also to provide a viable alternative to down. The inventors have unexpectedly found that it is possible to bond the wool fibres into the web structure.

The invention accordingly provides a method of forming a non-woven material comprising blending both synthetic and wool fibres in a web, and stabilising the web by utilising a bonding medium to form dispersed bonds between the fibres, wherein the wool fibres have been subjected before formation of the web to a pretreatment effective to modify the epicuticle of the wool so as to substantially increase the surface energy of the wool fibres without destroying their integrity to an extent sufficient for the wool fibres to accept the bonding medium in the web, whereby said dispersed bonds include bonds with wool fibres substantially effective to hold the wool fibres of the material in the web.

The invention also provides a method of pretreating wool fibres to render them susceptible to accept a bonding medium, comprising subjecting the fibres to a treatment effective to modify the epicuticle of the wool so as to substantially increase the surface energy of the wool fibres without destroying their integrity to an extent sufficient for the wool fibres to accept a bonding medium.

The invention still further provides a non-woven material comprising a web of both synthetic and wool fibres stabilised by dispersed bonds between the fibres provided by a bonding medium, characterized in that said dispersed bonds include bonds with wool fibres of the web substantially effective to hold the wool fibres of the material in the web.

DETAILED DESCRIPTION

The pretreatment for the wool fibres is advantageously a treatment which proceeds at such rate that it is effective at the surface but preferably has substantially not penetrated the interior of the wool fibres. The wool fibres may preferably be sprayed with fluid for effecting said pretreatment, but also may be immersed in a bath of the treatment fluid. The resultant-modification of the epicuticle of the wool may be by way of etching or removal, or other modification.

It has been surprisingly found that convenient treatments to achieve the required bonding susceptibility include adaptations of treatments previously employed to shrinkproof wool fibres. In general, the treatments required for the purposes of the present invention are more severe than those used for the purposes of shrinkproofing but, contrary to expectations, do achieve a sufficiently higher surface energy without destroying the integrity of the fibres.

The pretreatment therefore preferably comprises a degradative chemical treatment in which the critical parameter is set so that the modification of the epicuticle of the wool is greater than required to shrinkproof the wool fibres. Alternatively, a physical pretreatment such as a plasma treatment or mechanical abrasion may be employed. The degradative chemical treatment may be an acid etching or permanganate treatment but most preferably comprises acid chlorination of the fibres.

Acid chlorination can be done with either sodium hypochlorite in hydrochloric acid solution, or a solution of chlorine gas or other reagents designed to liberate chlorine in solution, e.g. dichloroisocyanuric acid and its salts (DCCA). The preferred level of treatment is exhaustion of at least 3% of chlorine on the weight of wool and most preferred is a 4–8% treatment. The preferred pH is lower than 5.5 and most preferred is the range 2.0 to 3.5. This treatment is then followed by neutralization e.g. with bisulphite or sulphite, and rinsing of the wool. The wool may be dyed before or after chlorination if required. These treatments may be suitably carried out using the commercially available KROY machinery, available from Kroy Corporation of Canada, that is normally used as a shrinkproofing process.

The bonding medium conveniently comprises low melting point thermoplastic fibres or conjugate e.g. bicomponent, thermoplastic fibres initially included with or comprising the synthetic fibres during formation of the web. The web is preferably a random web, for example in the form of a batt of the material, or may be compressed to form a thin paper-like structure. The invention is especially useful, however, in the formation of an open lofty web.

An appropriate synthetic fibre, also providing the bonding medium, comprises polyester based conjugate fibre. It is advantageous to use a synthetic fibre of similar diameter to that of the wool fibres. A suitable such conjugate fibre is the MELTY 4080 bicomponent fibre manufactured by Unitika of Japan. Other conjugate fibres which may be employed are the polyolefin based fibres produced by the Chisso Corporation of Japan and the Daiwabo Corporation (Japan). Some other suitable synthetic binder fibres include copolyester binder fibres, for example from Eastman Chemical Company, Mini Fibers Inc., or EMS Grilon SA, and vinyl acetate/vinyl chloride copolymer fibres from Wacker-Chemie GmbH. Conjugate nylon fibres although possible are less satisfactory due to their higher softening/melting point range.

Where the synthetic fibre is a polyester based conjugate thermoplastic fibre the non-woven material formed preferably contains at least 20% by weight of synthetic fibre. After formation of the unbonded web the structure is advantageously heated under suitable conditions of temperature and time, appropriate to the specific fibres in use, to melt the lower melting point thermoplastic component of the blend of fibres. This melted component then flows over and is accepted by adjacent fibres. On cooling, a network of bonds is formed, thereby stabilizing the structure. The pretreatment of the wool ensures that satisfactory bonds are formed between the wool and the synthetic fibres and not just between the synthetic fibres themselves. This is vital particularly in low density applications where the total number of crossover points between fibres, that is potential bonding sites, is very small.

The pretreated wool fibres and the synthetic fibres are preferably blended together to give an intimate blend. This process is well known and, for example, can be the output of a carding machine or an airlaid carding machine. Other blending mechanisms may be equally adequate providing uniform blending is achieved. This blend of fibres is in the form of a batt of fibres which can, if necessary, be compressed to produce products of higher densities.

There are many possible end uses of this invention. Some applications include continental quilts and quilted products, pillows, mattresses, cushions, clothing, inner soles for shoes, insulation materials, and as a substitute for polyurethane foam.

EXAMPLE

Various insulating materials in accordance with the invention were formed by blending conjugate thermoplastic polyester fibres, specifically Melty 4080 bicomponent fibres, with wool fibres of diameter 25 μm. These had been pretreated by acid chlorination, as described above, entailing exhaustion of 6% of chlorine on the weight of the wool from a solution having a pH in the range 2.0 to 3.5. The synthetic to wool blend ratio was 20% to 80% by weight. The fibres were blended together as described above to produce a low density web.

After formation of the open lofty web the structure was heated for 10 mins in an oven preheated to 150° C., to melt the lower melting point component of the bicomponent fibres. The melted polyester flowed over and was accepted by the wool fibres. On cooling of the structure, observation of the batt under the microscope revealed dispersed localized bonds formed not only between the synthetic fibres but also between the synthetic and wool fibres.

These experimental non-woven materials were formed as batts which were found to have highly satisfactory properties. They had a packing fraction of 0.003, i.e. similar to down, and in a test of resilience where each batt was compressed cyclically a large number of times, loss of thickness of the batt was much less than that noticed with batts formed in accordance with the aforementioned WRONZ disclosure. In the latter, the wool fibres, not being bound into the web structure, do not help prevent the collapse of the structure. The resilience of the batts formed according to the invention was found to be similar to that of polyester batts of the prior art. Sample quilts were also formed from the experimental batts of non-woven material and their thermal properties measured. The warmth to weight ratio was found in each case to at least equal those of similar quilts formed from down. Down is of course relatively more expensive than wool.

I claim:

1. A non-woven material comprising a web of both synthetic and wool fibres stabilised by dispersed bonds between the fibres provided by a thermoplastic bonding medium, wherein said wool fibers have been subjected to an acid chlorination treatment comprising exhaustion of at least about 3% of chlorine, based on the weight of wool, from a solution having a pH lower than about 5.5, the amount of chlorine and the pH being selected so that said treatment is effective to modify the epicuticle of the wool so as to substantially increase the surface free energy of the wool fibres without destroying their integrity to an extent sufficient for the wool fibres to accept the thermoplastic bonding medium of the web, whereby said dispersed bonds include bonds with wool fibres of the web substantially effect to hold the wool fibers of the material in the web.

2. A non-woven material according to claim 1 wherein said web is an open lofty web.

3. A non-woven material according to claim 1 wherein said thermoplastic bonding medium and said synthetic fibers comprise low melting point thermoplastic fibres.

4. A non-woven material according to claim 1 wherein said thermoplastic bonding medium and said synthetic fibers comprise respective components of conjugate thermoplastic fibres.

5. A method of forming a non-woven material comprising blending both synthetic and wool fibres in a web, and stabilising the web by utilising a thermoplastic bonding medium to form dispersed bonds between the fibres, wherein the wool fibres have been subjected before formation of the web to an acid chlorination pretreatment comprising exhaustion of at least about 3% of chlorine, based on the weight of wool, from a solution having a pH lower than about 5.5, the amount of chlorine and the pH being selected so that said pretreatment is effective to modify the epicuticle of the wool so as to substantially increase the surface free energy of the wool fibres without destroying their integrity to an extent sufficient for the wool fibres to accept the thermoplastic bonding medium of the web, whereby said dispersed bonds include bonds with wool fibers substantially effective to hold the wool fibres of the material in the web.

6. A method according to claim 5, wherein the pretreatment is a treatment which proceeds at such a rate that it is effective at the surface of the wool fibres but has substantially not penetrated the interior of the fibres.

7. A method according to claim 1, wherein said acid chlorination comprises exhaustion of chlorine, in the range of 4% to 8% based on the weight of wool, from a solution having a pH in the range of 2.0 to 3.5.

8. A method according to claim 5, wherein the web is an open lofty web.

9. A method according to claim 5, wherein the bonding medium comprises low melting point thermoplastic fibres or conjugate thermoplastic fibres initially included with or comprising said synthetic fibres during blending of the web.

10. A method according to claim 8, wherein the bonding medium and said synthetic fibres comprises conjugate thermoplastic fibres, and the non-woven material comprises at least 20% by weight of such conjugate thermoplastic fibres.

11. A method according to claim 1, further comprising the step of heating said fibers for at least ten minutes in an oven preheated to approximately 150° C.

12. A method according to claim 5 wherein said thermoplastic bonding medium and said synthetic fibers comprise low melting point thermoplastic fibres.

13. A method according to claim 5 wherein said thermoplastic bonding medium and said synthetic fibers comprise respective components of conjugate thermoplastic fibres.

* * * * *

UNITED STATES PATENT AND TRADEMARK OFFICE

CERTIFICATE OF CORRECTION

PATENT NO. : 5,298,320

DATED : March 29, 1994

INVENTOR(S) : Geoffrey R.S. Naylor

It is certified that error appears in the above-identified patent and that said Letters Patent is hereby corrected as shown below:

On the Title Page, item [75],

Please change the inventor's name from "Robert R.S. Geoffrey" to --Geoffrey R.S. Naylor--.

Signed and Sealed this

Second Day of August, 1994

*Attest:*

*Attesting Officer*

BRUCE LEHMAN

*Commissioner of Patents and Trademarks*